US011380281B2

(12) United States Patent
Xiao

(10) Patent No.: US 11,380,281 B2
(45) Date of Patent: Jul. 5, 2022

(54) COMMON VOLTAGE COMPENSATION CIRCUIT COMPRISING A FIRST RESISTOR ARRAY AND A SECOND RESISTOR ARRAY AND COMPENSATION SYSTEM FOR DISPLAY PANEL

(71) Applicant: TCL CHINA STAR OPTOELECTRONICS TECHNOLOGY CO., LTD., Shenzhen (CN)

(72) Inventor: Bo Xiao, Shenzhen (CN)

( * ) Notice: Subject to any disclaimer, the term of this patent is extended or adjusted under 35 U.S.C. 154(b) by 295 days.

(21) Appl. No.: 16/619,090

(22) PCT Filed: Aug. 13, 2019

(86) PCT No.: PCT/CN2019/100335
§ 371 (c)(1),
(2) Date: Dec. 4, 2019

(87) PCT Pub. No.: WO2021/012327
PCT Pub. Date: Jan. 28, 2021

(65) Prior Publication Data

US 2021/0358446 A1 Nov. 18, 2021

(30) Foreign Application Priority Data

Jul. 24, 2019 (CN) ..... 201910673259.5

(51) Int. Cl.
*G09G 3/36* (2006.01)

(52) U.S. Cl.
CPC ... *G09G 3/3696* (2013.01); *G09G 2320/0209* (2013.01); *G09G 2360/145* (2013.01)

(58) Field of Classification Search
None
See application file for complete search history.

(56) References Cited

U.S. PATENT DOCUMENTS 9,483,991 B2 11/2016 Min et al.
2004/0117856 A1* 6/2004 Barsoum ..... H04N 21/235 725/138

(Continued)

FOREIGN PATENT DOCUMENTS

CN 104050942 A 9/2014
CN 107799082 A 3/2018

(Continued)

OTHER PUBLICATIONS

MAXIM Low-Power Digital Potentiometers (Year: 2001).*

*Primary Examiner* — Chad M Dicke

(57) ABSTRACT

A common voltage compensation circuit and a compensation system for a display panel are provided. A compensation circuit includes a compensating unit configured to receive a common voltage outputted by the display panel; compensate the common voltage according to a compensation coefficient; and output the compensated common voltage to the display panel; and an adjusting unit configured to connect with a controlling unit in a phase of adjusting the display panel; receive an adjustment signal outputted by the controlling unit; and adjust the compensation coefficient of the compensating unit according to the adjustment signal.

13 Claims, 4 Drawing Sheets

(56) References Cited

U.S. PATENT DOCUMENTS

| | | | | |
|---|---|---|---|---|
| 2007/0139343 | A1* | 6/2007 | Wang | G09G 3/3655 345/98 |
| 2012/0162184 | A1* | 6/2012 | Kim | G09G 3/3655 345/212 |
| 2014/0355316 | A1* | 12/2014 | Wu | H02M 1/4225 363/21.16 |
| 2015/0356951 | A1 | 12/2015 | Wang | |
| 2016/0309352 | A1* | 10/2016 | Yuan | H02J 13/0079 |

FOREIGN PATENT DOCUMENTS

| | | | |
|---|---|---|---|
| CN | 108986456 | A | 12/2018 |
| KR | 101266762 | B1 | 5/2013 |
| KR | 20170105173 | A | 9/2017 |

* cited by examiner

COMMON VOLTAGE COMPENSATION CIRCUIT COMPRISING A FIRST RESISTOR ARRAY AND A SECOND RESISTOR ARRAY AND COMPENSATION SYSTEM FOR DISPLAY PANEL

BACKGROUND OF DISCLOSURE

1. Field of Disclosure

The present disclosure relates to the technical field of display panels, and more particularly, to a common voltage compensation circuit and a compensation system for a display panel.

2. Description of Related Art

The background of the present disclosure is merely provided in the description herein without necessarily constituting conventional technologies.

In liquid-crystal display devices, as some electric leakage may exist in thin film transistors (TFTs) and as a capacitance effect exists between TFTs, voltages between adjacent data lines are affected by capacitances to influence with each other, thereby resulting in a crosstalk phenomenon. In general, compensation parameters of a common voltage VCOM for the deflections of liquid-crystal molecules are required to be adjusted to improve the crosstalk phenomenon so that the display effects of liquid-crystal panels can be adjusted.

Generally, the selection of the compensation parameters of the VCOM can be realized through a VCOM compensation circuit. As shown in FIG. 1, which is a schematic diagram of a conventional VCOM compensation circuit. It has the following basic principles: a feedback common voltage VCOMFB_CELL is introduced at a feedback point in a display panel. An alternating current signal VCOM_FB is inputted into an inverting input (i.e., terminal "−" in FIG. 1) of an operational amplifier OP through a capacitor C, and a reversing feedback is introduced. A base common voltage VCOM_Ref is inputted into a non-inverting input (i.e., terminal "+" in FIG. 1) of the operational amplifier. The base common voltage can come from a power management integrated circuit (PMIC) of the display panel. An output of the operational amplifier outputs a common voltage compensation signal VCOM_OUT. The common voltage compensation signal is used as the compensated common voltage to be inputted into the display panel, thereby lessening a fluctuation of the VCOM of the display panel itself and improving display quality of liquid-crystal display panels. As shown in FIG. 1, it can be seen that a compensation coefficient k of the operational amplifier is calculated by: k=(VCOM_OUT−VCOM_Ref)/(VCOM_FB−VCOM_Ref) =−R1/R0. Thus, the compensation coefficient (i.e., an amplifying coefficient) of the operational amplifier can only be changed by changing a ratio of R1 to R0 in order to make the display panel best for display effects.

However, a compensation coefficient of a conventional VCOM compensation circuit is a constant value, that is, resistance values R0 and R1 are determined as a constant value through a best parameter verification, and the obtained best compensation coefficient is only suitable for a few display panels. For different display panels, as the extent of crosstalk is different due to various factors such as materials, processes, etc., the required compensation coefficient is different. If the VCOM is compensated using a constant compensation coefficient, the compensation effects of some display panels may be bad.

SUMMARY

A technical problem is as follows: the present disclosure provides a common voltage compensation circuit and a compensation system for a display panel, which acquire an adjustment signal to adjust a compensation coefficient of a compensating unit by connecting an adjusting unit with an external controlling unit in the phase of adjusting the display panel. The display panel with a different extent of crosstalk can acquire a different compensation coefficient through the adjusting unit. Also, a common voltage of a corresponding display panel is compensated according to the acquired compensation coefficient, thereby solving the technical problem that bad compensation effects of different display panels are caused by the unadjusted compensation coefficient of the common voltage compensation circuit.

In order to solve the above problem, the present disclosure provides a technical solution as follows:

The present disclosure provides a common voltage compensation circuit for a display panel, including:

a compensating unit configured to: receive a common voltage outputted by the display panel; compensate the common voltage according to a compensation coefficient; and output the compensated common voltage to the display panel; and an adjusting unit configured to: connect with a controlling unit in a phase of adjusting the display panel; receive an adjustment signal outputted by the controlling unit; and adjust the compensation coefficient of the compensating unit according to the adjustment signal.

In the common voltage compensation circuit of the present disclosure, the adjusting unit includes a first resistor and an adjustable varistor, and the compensation coefficient is a resistance ratio of the adjustable varistor to the first resistor;

wherein the adjusting unit is further configured to adjust a resistance value of the adjustable varistor to adjust the compensation coefficient according to the adjustment signal.

In the common voltage compensation circuit of the present disclosure, the compensating unit includes an operational amplifier, an inverting input of the operational amplifier is electrically connected to a common-voltage providing terminal of the display panel through the first resistor, a non-inverting input of the operational amplifier is electrically connected to a base common-voltage providing terminal of the display panel, one end of the adjustable varistor is electrically connected to the inverting input of the operational amplifier, the other end of the adjustable varistor is electrically connected to an output of the operational amplifier, and the output of the operational amplifier is configured to output the compensated common voltage.

In the common voltage compensation circuit of the present disclosure, the adjustable varistor includes a sliding varistor.

In the common voltage compensation circuit of the present disclosure, the adjustable varistor includes a digital potentiometer.

In the common voltage compensation circuit of the present disclosure, the digital potentiometer includes:

a first resistor-array unit electrically connected to the compensating unit and configured to adjust the compensation coefficient of the compensating unit according to a change of resistance values;

a first switch unit electrically connected to the first resistor-array unit and configured to adjust a resistance value of the first resistor-array unit according to a working state of switches; and a first signal-processing unit electrically connected to the first switch unit and configured to: connect with the controlling unit in the phase of adjusting the display panel; receive the adjustment signal outputted by the controlling unit; and adjust a working state of switches in the first switch unit according to the adjustment signal.

In the common voltage compensation circuit of the present disclosure, the first resistor-array unit includes a plurality of parallel resistors arranged from small to great resistance values.

In the common voltage compensation circuit of the present disclosure, the compensating unit includes an operational amplifier, an inverting input of the operational amplifier is electrically connected to a common-voltage providing terminal of the display panel through the first resistor, a non-inverting input of the operational amplifier is electrically connected to a base common-voltage providing terminal of the display panel, one end of the first resistor-array unit is electrically connected to the inverting input of the operational amplifier, the other end of the first resistor-array unit is electrically connected to an output of the operational amplifier, and the output of the operational amplifier is configured to output the compensated common voltage.

In the common voltage compensation circuit of the present disclosure, the digital potentiometer further includes a first storage unit electrically connected to the first signal-processing unit and configured to store the adjustment signal outputted by the controlling unit.

In the common voltage compensation circuit of the present disclosure, the adjusting unit includes:

a resistor-array unit electrically connected to the compensating unit and configured to adjust the compensation coefficient of the compensating unit according to a change of resistance values;

a switch unit electrically connected to the resistor-array unit and configured to adjust a resistance value of the resistor-array unit according to a working state of switches; and a signal-processing unit electrically connected to the switch unit and configured to: connect with the controlling unit in the phase of adjusting the display panel; receive the adjustment signal outputted by the controlling unit; and adjust a working state of switches in the switch unit according to the adjustment signal.

In the common voltage compensation circuit of the present disclosure, the resistor-array unit includes a first resistor array and a second resistor array both electrically connected to the switch unit, and the compensation coefficient is a resistance ratio of the second resistor array to the first resistor array;

wherein the adjusting unit is further configured to adjust resistance values of the first resistor array and the second resistor array to adjust the compensation coefficient according to the adjustment signal.

In the common voltage compensation circuit of the present disclosure, the compensating unit includes an operational amplifier, one end of the first resistor array is electrically connected to a common-voltage providing terminal of the display panel, the other end of the first resistor array is electrically connected to one end of the second resistor array and to an inverting input of the operational amplifier, the other end of the second resistor array is electrically connected to an output of the operational amplifier, a non-inverting input of the operational amplifier is electrically connected to a base common-voltage providing terminal, and the output of the operational amplifier is configured to output the compensated common voltage.

In the common voltage compensation circuit of the present disclosure, the first resistor array includes a plurality of parallel resistors arranged from small to great resistance values.

In the common voltage compensation circuit of the present disclosure, the second resistor array includes a plurality of parallel resistors arranged from small to great resistance values.

In the common voltage compensation circuit of the present disclosure, the adjusting unit further includes a second storage unit electrically connected to the signal-processing unit and configured to store the adjustment signal outputted by the controlling unit.

An embodiment of the present disclosure further provides a common voltage compensation circuit for a display panel, including a compensating unit and an adjusting unit;

wherein the compensating unit is configured to: receive a common voltage outputted by the display panel; compensate the common voltage according to a compensation coefficient; and output the compensated common voltage to the display panel; and wherein the adjusting unit includes:

a resistor-array unit electrically connected to the compensating unit and configured to adjust the compensation coefficient of the compensating unit according to a change of resistance values;

a switch unit electrically connected to the resistor-array unit and configured to adjust a resistance value of the resistor-array unit according to a working state of switches; and a signal-processing unit electrically connected to the switch unit and configured to: connect with the controlling unit in the phase of adjusting the display panel; receive the adjustment signal outputted by the controlling unit; and adjust a working state of switches in the switch unit according to the adjustment signal.

An embodiment of the present disclosure further provides a common voltage compensation system for a display panel, including a controlling unit and the common voltage compensation circuit of the above display panel;

wherein the controlling unit is configured to connect with the adjusting unit of the common voltage compensation circuit in the phase of adjusting the display panel and to output the adjustment signal to the adjusting unit.

In the common voltage compensation system of the present disclosure, the compensation system further includes a light sensor connected to the controlling unit and configured to: capture brightness information in different positions of the display panel in the phase of adjusting the display panel; and transmit the brightness information to the controlling unit;

wherein the controlling unit is further configured to compute the adjustment signal according to the brightness information.

In the common voltage compensation system of the present disclosure, the light sensor includes a first light probe and a second light probe, and the display panel includes a normal display region and a crosstalk display region;

wherein the first light probe is disposed corresponding to the normal display region and is configured to acquire a first brightness information in the normal display region;

wherein the second light probe is disposed corresponding to the crosstalk display region and is configured to acquire a second brightness information in the crosstalk display region; and wherein the controlling unit is further configured to: compute the adjustment signal according to a difference value between the first brightness information and the second brightness information; and output the adjustment signal to the adjusting unit.

In the common voltage compensation system of the present disclosure, the adjusting unit includes:

a resistor-array unit electrically connected to the compensating unit and configured to adjust the compensation coefficient of the compensating unit according to a change of resistance values;

a switch unit electrically connected to the resistor-array unit and configured to adjust a resistance value of the resistor-array unit according to a working state of switches; and a signal-processing unit electrically connected to the switch unit and configured to: connect with the controlling unit in the phase of adjusting the display panel; receive the adjustment signal outputted by the controlling unit; and adjust a working state of switches in the switch unit according to the adjustment signal.

The beneficial effect of the present disclosure is as follows: the present disclosure provides a common voltage compensation circuit to acquire the adjustment signal to adjust the compensation coefficient of the compensating unit by connecting the adjusting unit with the external controlling unit in the phase of adjusting the display panel. The display panel with a different extent of crosstalk can acquire a different compensation coefficient through the adjusting unit. Also, a common voltage of a corresponding display panel is compensated in order to acquire a better compensation effect. In addition, the controlling unit of the present disclosure is an external device which only connect with the adjusting unit of the common voltage compensation circuit in the phase of adjusting the display panel. Also, the controlling unit provides the adjustment signal to the adjusting unit. The adjusting unit adjusts the compensation coefficient of the compensating unit according to the adjustment signal, and thus the common voltage of the display panel is compensated to eliminate a crosstalk phenomenon. The present disclosure does not need to change an original timing controller and a GAMMA controller of the display panel and thus has advantages such as low costs and simple operation.

BRIEF DESCRIPTION OF DRAWINGS

In order to more clearly illustrate the embodiments of the present disclosure or technical solutions in conventional technologies, the drawings required for describing of the embodiments or conventional technologies will be briefly introduced below. It is obvious that the following drawings are merely some embodiments of the present disclosure, and a person having ordinary skill in this field can obtain other drawings according to these drawings under the premise of not paying creative works.

DETAILED DESCRIPTION OF EMBODIMENTS

Figure 1:
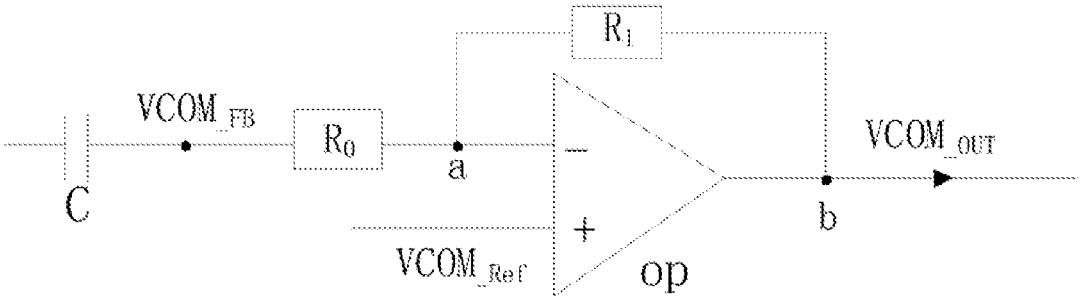
FIG. 1 is an exemplary, schematic diagram of a common voltage compensation circuit for a display panel.

The specific structure and function details disclosed herein are merely representative, and are intended to describe exemplary embodiments of the present application. However, the present application can be specifically embodied in many alternative forms, and should not be interpreted to be limited to the embodiments described here.

In the description of the present application, it should be understood that, orientation or position relationships indicated by the terms such as "center", "transversal", "upper", "lower", "left", "right", "vertical", "horizontal", "top", "bottom", "inner", "outer", etc. are based on the orientation or position relationships as shown in the drawings, merely for ease of the description of the present application and simplifying the description only, rather than indicating or implying that the indicated device or element must have a particular orientation or be constructed and operated in a particular orientation. Therefore, these terms should not to be understood as a limitation to the present application. In addition, the terms "first" and "second" are merely for a descriptive purpose, and cannot be understood to indicate or imply a relative importance, or implicitly indicate the number of the indicated technical features. Hence, the features defined by "first" and "second" can explicitly or implicitly include one or more of the features. In the description of the present application, "a plurality of" means two or more, unless otherwise stated. In addition, the term "comprise" and any variations thereof are intended to cover a non-exclusive inclusion.

In the description of the present application, it should be understood that, unless otherwise specified and defined, the terms "install", "connected with", and "connected to" should be comprehended in a broad sense. For example, these terms may be comprehended as being fixedly connected, detachably connected or integrally connected; mechanically connected or electrically connected; or directly connected or indirectly connected through an intermediate medium, or in an internal communication between two elements. The specific meanings about the foregoing terms in the present application may be understood for those skilled in the art according to specific circumstances.

The terms used herein are merely for the purpose of describing the specific embodiments, and are not intended to limit the exemplary embodiments. As used herein, the singular forms "a" and "an" are intended to include the plural forms as well, unless otherwise indicated in the context clearly. It will be further understood that the terms "comprise" and/or "include" used herein specify the presence of stated features, integers, steps, operations, elements and/or components, but do not preclude the presence or addition of one or more other features, integers, steps, operations, elements, components and/or combinations thereof.

The present application is further described below with reference to the accompanying drawings and embodiments.

Figure 2:
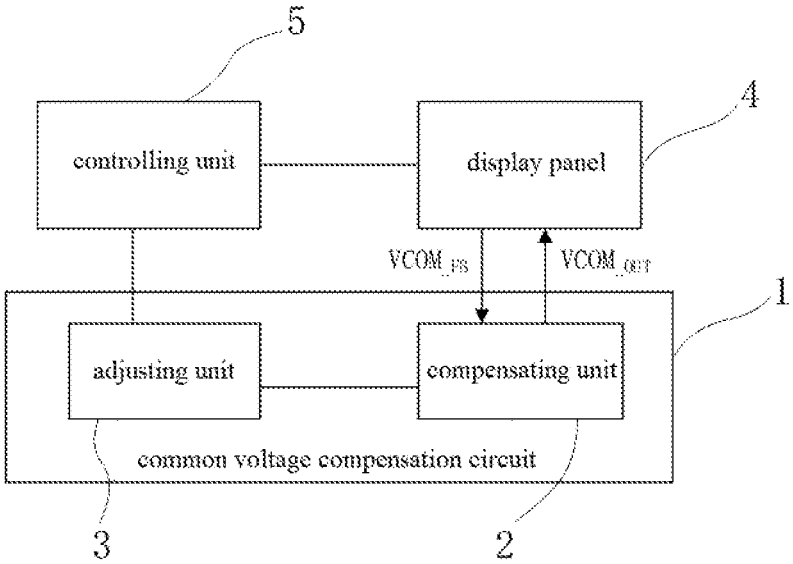
FIG. 2 is a schematic structural diagram of a common voltage compensation circuit for a display panel according to an embodiment of the present disclosure.

As shown in FIG. 2, an embodiment of the present disclosure provides a common voltage compensation circuit 1 for a display panel, the common voltage compensation circuit 1 including a compensating unit 2 and an adjusting unit 3.

The compensating unit 2 is configured to receive a common voltage outputted by the display panel 4; compensate the common voltage according to a compensation coefficient; and output the compensated common voltage to the display panel 4.

The adjusting unit 3 is configured to connect with a controlling unit 5 in a phase of adjusting the display panel; receive an adjustment signal outputted by the controlling unit 5; and adjust the compensation coefficient of the compensating unit 2 according to the adjustment signal.

Specifically, the compensating unit 2 receives a common voltage VCOM_FB. It needs to be stated that VCOM_FB is an alternating current feedback common voltage obtained by a capacitor C filtering a direct current voltage in a feedback common voltage in the display panel 4. The compensated common voltage VCOM_OUT from an output of the compensating unit 2 is inputted into the display panel 4, which can lessen a fluctuation of a common voltage of the display panel itself and thus improve display quality of the display panel 4.

Specifically, the controlling unit 5 is an external device which only connect with the adjusting unit 3 in the phase of adjusting the display panel. Also, the controlling unit 5 acquires an adjustment signal according to picture quality of the display panel 4 (that is, the extent of crosstalk or brightness differences in different positions) and outputs the adjustment signal to the adjusting unit 3.

In the present embodiment, the adjustment signal is acquired to adjust the compensation coefficient of the compensating unit 2 by connecting the adjusting unit 3 with the external controlling unit 5 in the phase of adjusting the display panel. The display panel 4 with a different extent of crosstalk can acquire a different compensation coefficient through the adjusting unit 3. Also, a common voltage of a corresponding display panel 4 is compensated in order to acquire a better compensation effect (i.e., eliminating crosstalk). The controlling unit 5 of the present disclosure is an external device which only connect with the adjusting unit 3 of the common voltage compensation circuit 1 in the phase of adjusting the display panel. Also, the controlling unit 5 provides the adjustment signal to the adjusting unit 3. The adjusting unit 3 adjusts the compensation coefficient of the compensating unit 2 according to the adjustment signal, and thus the common voltage of the display panel 4 is compensated to eliminate a crosstalk phenomenon. The present disclosure does not need to change an original timing controller and a GAMMA controller of the display panel 4 and thus has advantages such as low costs and simple operation.

Figure 3:
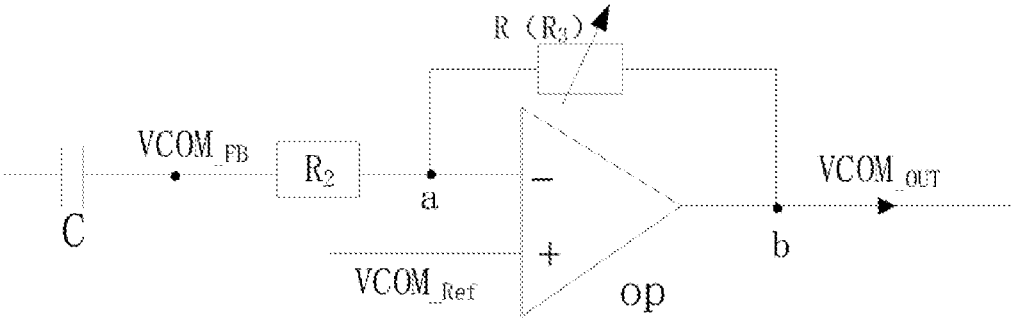
FIG. 3 is a schematic diagram of a common voltage compensation circuit for a display panel according to an embodiment of the present disclosure.

In an embodiment as shown in FIG. 3, the adjusting unit 3 includes a first resistor R2 and an adjustable varistor R, and the compensation coefficient is a resistance ratio of the adjustable varistor R to the first resistor R2. The adjusting unit 3 is further configured to adjust a resistance value of the adjustable varistor R to adjust the compensation coefficient according to the adjustment signal.

Specifically, the adjustable varistor R includes a sliding varistor R3. Correspondingly, the adjustment signal includes resistance information of the adjustable varistor R.

In the present embodiment, for different display panels 4, picture quality of each display panel 4 can be acquired by the controlling unit 5, and different adjustment signals can be acquired according to different picture quality, causing the adjusting unit 3 of the common voltage compensation circuit 1 of the display panel 4 to adjust the resistance value of the adjustable varistor R according to a corresponding adjustment signal. Thus, a corresponding compensating unit 2 acquires a better compensation coefficient to compensate the common voltage, and each display panel 4 eventually acquires a better compensation effect to eliminate crosstalk.

In an embodiment as shown in FIG. 3, the compensating unit 2 includes an operational amplifier OP. An inverting input of the operational amplifier OP is electrically connected to a common-voltage providing terminal (for providing VCOM_FB) of the display panel 4 through the first resistor R2. A non-inverting input of the operational amplifier OP is electrically connected to a base common-voltage providing terminal of the display panel 4. One end of the adjustable varistor R is electrically connected to the inverting input of the operational amplifier OP. The other end of the adjustable varistor R is electrically connected to an output of the operational amplifier OP. The output of the operational amplifier OP is configured to output the compensated common voltage VCOM_OUT.

Specifically, a base common voltage includes a reference common voltage VCOM_Ref provided by a power terminal of the display panel 4.

In the present embodiment, two ends of the adjustable varistor R in the adjusting unit 3 are connected to the inverting input and the output of the operational amplifier OP respectively, causing the operational amplifier OP to compensate the common voltage for negative feedback. The structure of the compensation circuit of the embodiment is simple to be beneficial to reduce a layout area of a circuit board of the display panel 4, thereby reducing economical costs.

Figure 4:
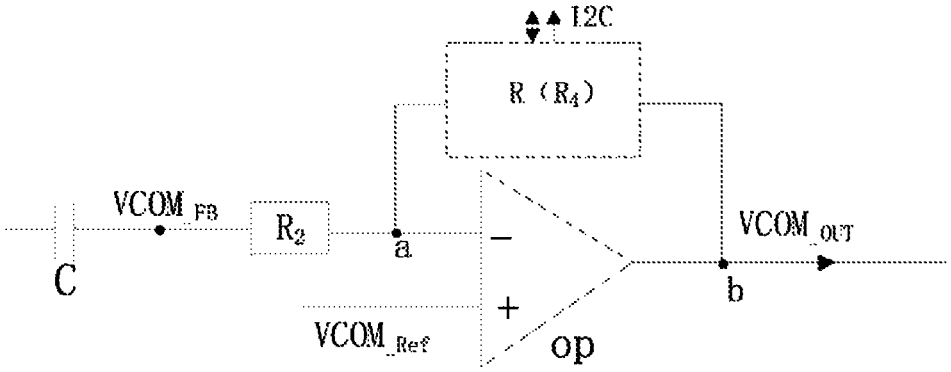
FIG. 4 is a schematic diagram of another common voltage compensation circuit for a display panel according to an embodiment of the present disclosure.
Figure 5:
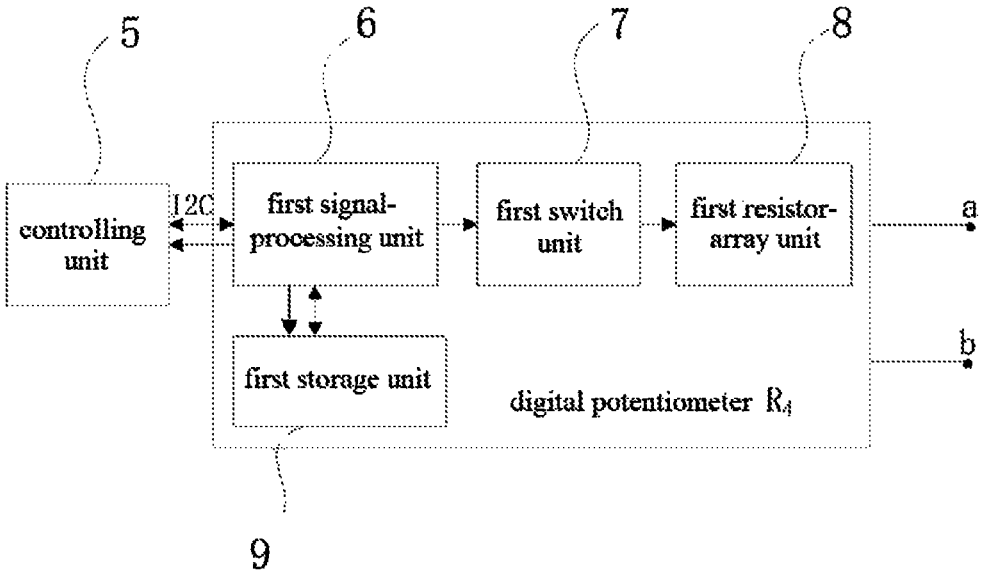
FIG. 5 is a schematic structural diagram of a digital potentiometer according to an embodiment of the present disclosure.

As shown in FIGS. 4-5, an embodiment of the present disclosure further provides a common voltage compensation circuit for a display panel. A difference that exists between the present embodiment and the above embodiments is that the adjustable varistor R is a digital potentiometer R4 (i.e., programmable potentiometer). The digital potentiometer R4 has a I2C total-line port and connects with the controlling unit 5 through the I2C total-line port in the phase of adjusting the display panel. The digital potentiometer R4 is used to automatically receive an adjustment signal and to adjust an output resistance according to the adjustment signal so that the compensation coefficient of the compensating unit 2 is adjusted.

Specifically, as shown in FIG. 5, the digital potentiometer R4 includes a first signal-processing unit 6, a first switch unit 7, and a first resistor-array unit 8 electrically connected sequentially. The first resistor-array unit 8 includes a plurality of parallel resistors. Of course, each of the resistors can be replaced by a plurality of parallel or series resistors. In addition, the parallel resistors of the first resistor-array unit 8 are arranged from small to great resistance values. The first switch unit 7 includes a plurality of switches (including simulate switches). Each of the switches and one or more resistors of the first resistor-array unit 8 can be connected in parallel or in series. The first switch unit 7 adjusts a resistance value of the first resistor-array unit 8 according to a working state of each switch. The I2C total-line port is disposed in the first signal-processing unit 6. The first signal-processing unit 6 is used to receive the adjustment signal outputted by the controlling unit 5 and to control a working state of the switches in the first switch unit 7 according to the adjustment signal.

Specifically, one end of the first resistor-array unit 8 is connected to the inverting input of the operational amplifier OP, and the other end of the first resistor-array unit 8 is connected to an output of the operational amplifier OP.

In the present embodiment, the first signal-processing unit 6 in the digital potentiometer R4 connects with the controlling unit 5 through I2C total lines and can automatically acquire the adjustment signal. Also, the first signal-processing unit 6 automatically adjust the working state of the switches in the first switch unit 7 according to the adjustment signal in order to adjust the resistance value of the first resistor-array unit 8. Thus, the compensation coefficient is adjusted, causing the compensation coefficient to be adjusted automatically and improving a compensation-adjusting efficiency and a compensation accuracy of the compensation circuit.

In an embodiment, the digital potentiometer R4 further has a first storage unit 9 electrically connected to the first signal-processing unit 6 and configured to store the adjustment signal outputted by the controlling unit 5.

Specifically, the adjustment signal stored in the first storage unit 9 has a better compensation effect.

In the present embodiment, a corresponding adjustment signal of the display panel 4 is stored in the first storage unit 9, causing the display panel 4 to automatically acquire the adjustment signal in the first storage unit 9 and to compensate the common voltage when the display panel 4 reboots. It is realized that the common voltage compensation circuit 1 of the display panel 4 automatically compensates the common voltage every time the display panel 4 boots to eliminate crosstalk without being adjusted again by the controlling unit 5.

Figure 6:
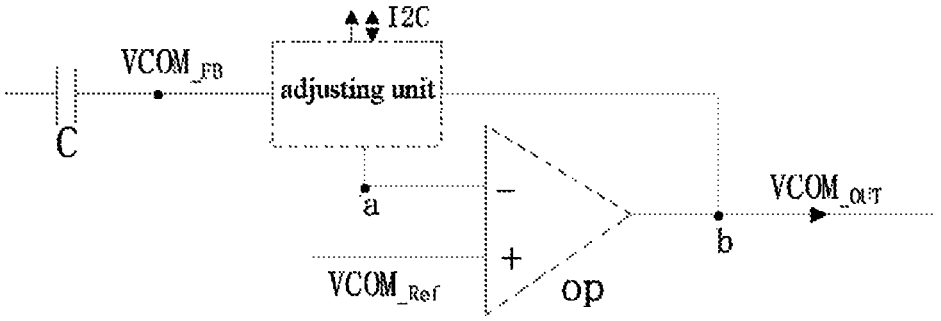
FIG. 6 is a schematic diagram of another common voltage compensation circuit for a display panel according to an embodiment of the present disclosure.
Figure 7:
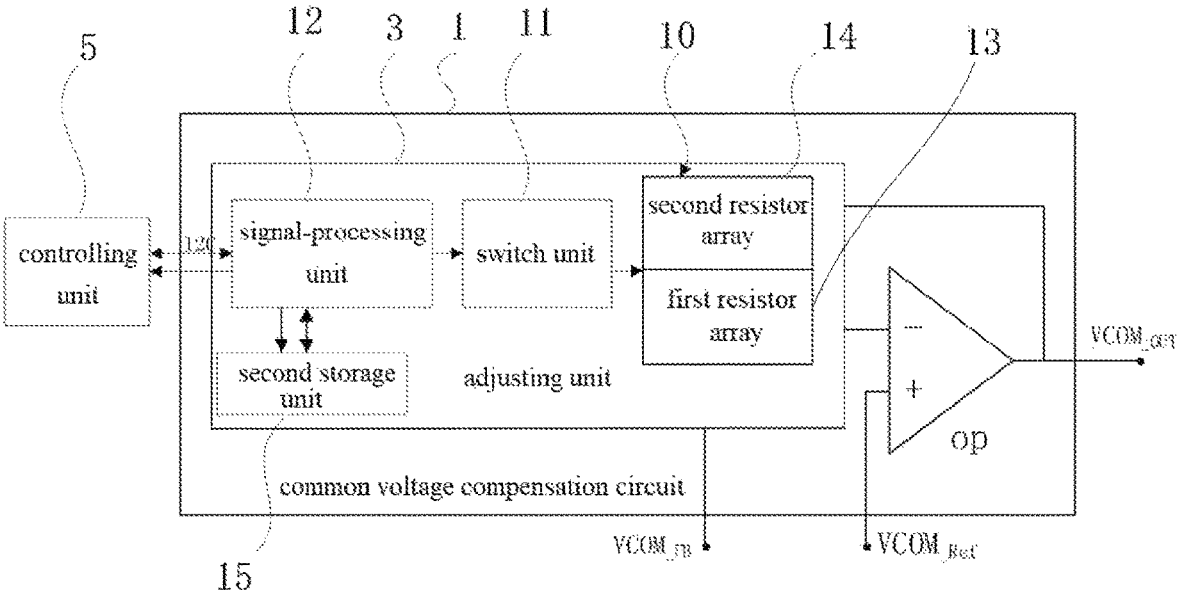
FIG. 7 is a schematic structural diagram of another common voltage compensation circuit for a display panel according to an embodiment of the present disclosure.

As shown in FIGS. 6-7, an embodiment of the present disclosure further provides a common voltage compensation circuit for a display panel. A difference that exists between the present embodiment and the above embodiments is that the adjusting unit 3 includes a resistor-array unit 10, a switch unit 11, and a signal-processing unit 12.

The resistor-array unit 10 is electrically connected to the compensating unit 2 and is configured to adjust the compensation coefficient of the compensating unit 2 according to a change of resistance values.

The switch unit 11 is electrically connected to the resistor-array unit 10 and is configured to adjust a resistance value of the resistor-array unit 10 according to a working state of switches.

The signal-processing unit 12 is electrically connected to the switch unit 11 and is configured to connect with the controlling unit 5 in the phase of adjusting the display panel 4; receive the adjustment signal outputted by the controlling unit 5; and adjust a working state of the switches in the switch unit 11 according to the adjustment signal.

Specifically, the resistor-array unit 10 includes a first resistor array 13 and a second resistor array 14 both electrically connected to the switch unit 11. The compensation coefficient is a resistance ratio of the second resistor array 14 to the first resistor array 13. The adjusting unit 3 is further configured to adjust resistance values of the first resistor array 13 and the second resistor array 14 to adjust the compensation coefficient according to the adjustment signal.

Specifically, the first resistor array 13 includes a plurality of parallel resistors. Of course, each of the resistors can also be replaced by a plurality of parallel or series resistors. In addition, the parallel resistors of the first resistor array 13 are arranged from small to great resistance values. The second resistor array 14 also includes a plurality of parallel resistors. Of course, each of the resistors can also be replaced by a plurality of parallel or series resistors. In addition, the parallel resistors of the second resistor array 14 are arranged from small to great resistance values.

Specifically, the switch unit 11 includes a plurality of switches (including simulate switches). Each of the switches and one or more resistors of the first resistor array 13 or the second resistor array 14 can be connected in parallel or in series. The switch unit 11 adjusts resistance values of the first resistor array 13 and the second resistor array 14 according to a working state of each switch.

Specifically, the I2C total-line port is disposed in the signal-processing unit 12. In the phase of adjusting the display panel, the signal-processing unit 12 connects with the controlling unit 5 through the I2C total-line port.

In the present embodiment, the signal-processing unit 12 in the adjusting unit 3 connects with the controlling unit 5 through I2C total lines and can automatically acquire the adjustment signal. Also, the signal-processing unit 12 automatically adjust the working state of the switches in the switch unit 11 according to the adjustment signal in order to adjust the resistance values of the first resistor array 13 and the second resistor array 14 in the resistor-array unit 10. Thus, the compensation coefficient is adjusted, causing the compensation coefficient to be adjusted automatically and improving a compensation-adjusting efficiency and a compensation accuracy of the compensation circuit.

In an embodiment, the compensating unit 2 includes an operational amplifier OP. One end of the first resistor array 13 is electrically connected to a common-voltage providing terminal of the display panel 4. The other end of the first resistor array 13 is electrically connected to one end of the second resistor array 14 and to an inverting input of the operational amplifier OP. The other end of the second resistor array 14 is electrically connected to an output of the operational amplifier OP. A non-inverting input of the operational amplifier OP is electrically connected to a base common-voltage providing terminal. The output of the operational amplifier OP is configured to output the compensated common voltage.

Specifically, the adjusting unit 3 and the operational amplifier OP can be integrated into a chip, that is, the compensation circuit is set as an integrated chip.

In the present embodiment, the resistor-array unit 10 is connected to the inverting input and the output of the operational amplifier OP, causing the operational amplifier OP to compensate the common voltage for negative feedback. In addition, the adjusting unit 3 and the operational amplifier OP can be integrated into a chip, causing the compensation circuit 1 to have a simple structure and smaller volume. It is beneficial to reduce a layout area of the circuit board of the display panel 4, thereby reducing economical costs.

In an embodiment, the adjusting unit 3 further includes a second storage unit 15 electrically connected to the signal-processing unit 12 and configured to store the adjustment signal outputted by the controlling unit 5.

Specifically, the adjustment signal stored in the second storage unit 15 has a better compensation effect.

In the present embodiment, a corresponding adjustment signal of the display panel 4 is stored in the second storage unit 15, causing the display panel 4 to automatically acquire the adjustment signal in the second storage unit 15 and to compensate the common voltage when the display panel 4 reboots. It is realized that the common voltage compensation circuit 1 of the display panel 4 automatically compensates the common voltage every time the display panel 4 boots to eliminate crosstalk without being adjusted again by the controlling unit 5.

Figure 8:
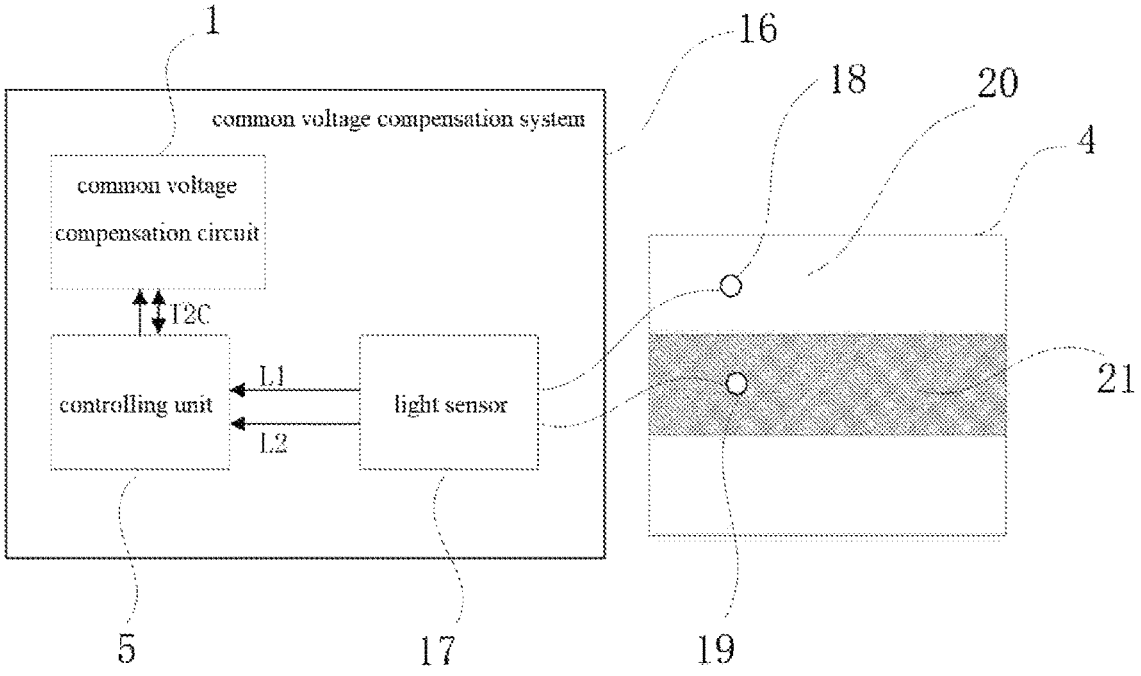
FIG. 8 is a schematic structural diagram of a common voltage compensation circuit for a display panel according to an embodiment of the present disclosure.

As shown in FIG. 8, an embodiment of the present disclosure further provides a common voltage compensation system 16 for a display panel, the compensation system 16 including a controlling unit 5 and the common voltage compensation circuit 1 of the above display panel. The controlling unit 5 is configured to connect with the adjusting unit of the compensation circuit 1 in the phase of adjusting the display panel and to output the adjustment signal to the adjusting unit.

Specifically, as shown in FIG. 2, which is a schematic structural diagram of the compensation circuit 1 including a compensating unit 2 and an adjusting unit 3.

Specifically, the controlling unit 5 is an external device which only connect with the adjusting unit 3 in the phase of adjusting the display panel. Also, the controlling unit 5 acquires an adjustment signal according to picture quality of the display panel 4 (that is, the extent of crosstalk or brightness differences in different positions) and outputs the adjustment signal to the adjusting unit 3.

In the present embodiment, the controlling unit 5 is an external controlling unit which only connect with the adjusting unit 3 in the phase of adjusting the display panel. Also, the controlling unit 5 provides the adjustment signal to the adjusting unit 3. The adjusting unit 3 adjusts the compensation coefficient of the compensating unit 2 according to the adjustment signal, and thus the common voltage of the display panel 4 is compensated to eliminate a crosstalk phenomenon. Such design does not need to change an original timing controller and a GAMMA controller of the display panel 4 and thus has advantages such as low costs and simple operation.

In an embodiment, the compensation system 16 further includes a light sensor 17. The light sensor 17 is connected to the controlling unit 5 and is configured to capture brightness information (including brightness values) in different positions of the display panel 4 in the phase of adjusting the display panel; and transmit the brightness information to the controlling unit 5. The controlling unit 5 is further configured to compute the adjustment signal according to the brightness information.

Specifically, the light sensor 17 includes a first light probe 18 and a second light probe 19. The display panel 4 includes a normal display region 20 and a crosstalk display region 21. The first light probe 18 is disposed corresponding to the normal display region 20 and is configured to acquire a first brightness information in the normal display region 20. The second light probe 19 is disposed corresponding to the crosstalk display region 21 and is configured to acquire a second brightness information in the crosstalk display region 21. The controlling unit 5 is further configured to compute the adjustment signal according to a difference value between the first brightness information and the second brightness information and to output the adjustment signal to the adjusting unit 3.

In the present embodiment, the light sensor 17 is also an external device. The first light probe 18 and the second light probe 19 of the light sensor 17 can acquire corresponding brightness information from the normal display region 20 and the crosstalk display region 21 of the display panel 4 respectively. The simple operation is suitable for different display panels 4, and each display panel 4 is prevented from being configured with the light sensor 17, thereby device costs are saved.

Figure 9:
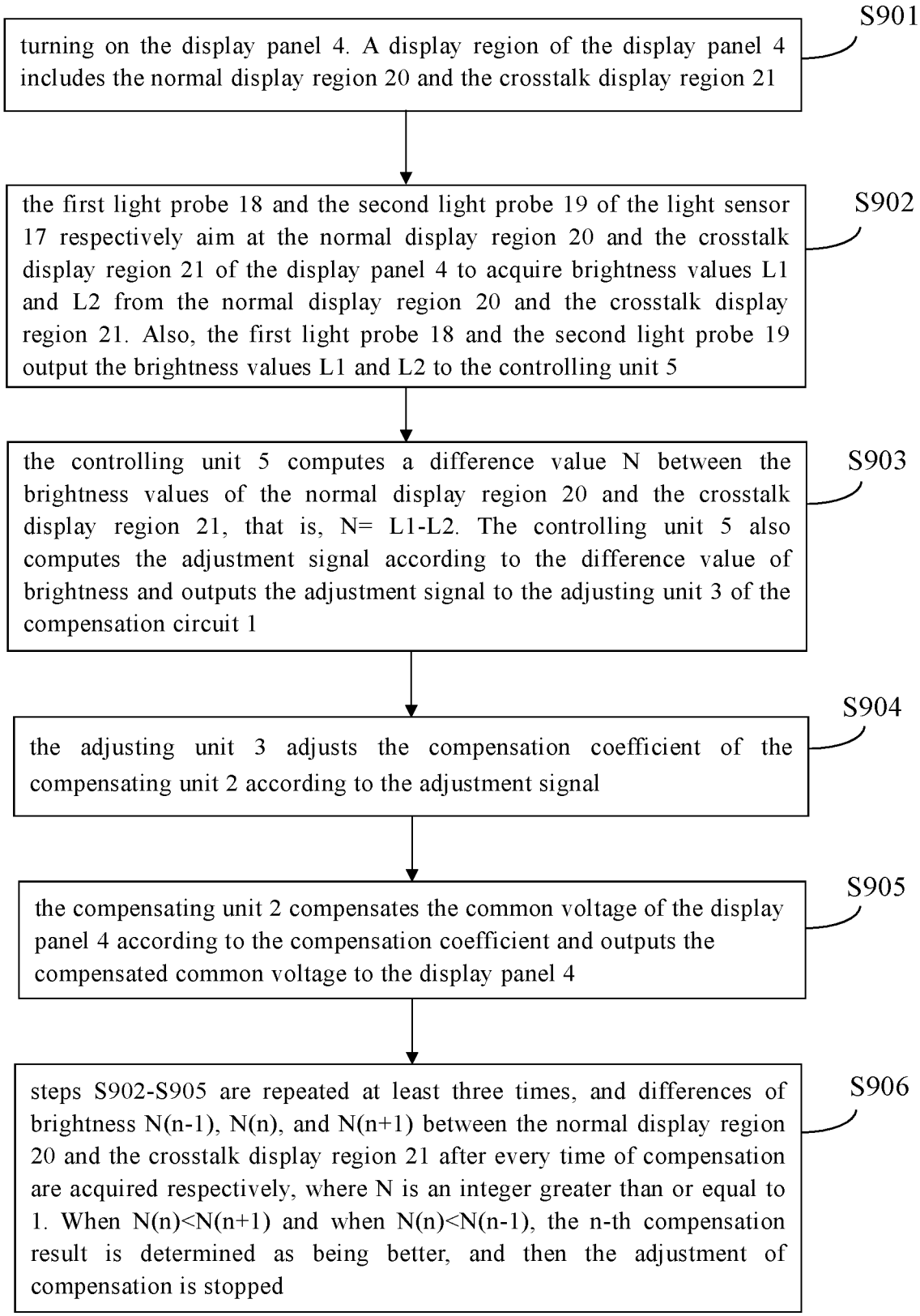
FIG. 9 is a flowchart illustrating a compensation adjustment method of a common voltage compensation system for a display panel according to an embodiment of the present disclosure.

In an embodiment, as shown in FIGS. 1, 8, and 9, the adjustment course of the common voltage compensation system 16 compensating the common voltage of the display panel 4 are as follows:

S901: turning on the display panel 4. A display region of the display panel 4 includes the normal display region 20 and the crosstalk display region 21.

S902: The first light probe 18 and the second light probe 19 of the light sensor 17 respectively aim at the normal display region 20 and the crosstalk display region 21 of the display panel 4 to acquire brightness values L1 and L2 from the normal display region 20 and the crosstalk display region 21. Also, the first light probe 18 and the second light probe 19 output the brightness values L1 and L2 to the controlling unit 5.

S903: the controlling unit 5 computes a difference value N between the brightness values of the normal display region 20 and the crosstalk display region 21, that is, N=L1−L2. The controlling unit 5 also computes the adjustment signal according to the difference value of brightness and outputs the adjustment signal to the adjusting unit 3 of the compensation circuit 1.

S904: the adjusting unit 3 adjusts the compensation coefficient of the compensating unit 2 according to the adjustment signal.

S905: the compensating unit 2 compensates the common voltage of the display panel 4 according to the compensation coefficient and outputs the compensated common voltage to the display panel 4.

S906: steps S902-S905 are repeated at least three times, and differences of brightness N(n−1), N(n), and N(n+1) between the normal display region 20 and the crosstalk display region 21 after every time of compensation are acquired respectively, where N is an integer greater than or equal to 1. When N(n)<N(n+1) and when N(n)<N(n−1), the n-th compensation result is determined as being better, and then the adjustment of compensation is stopped.

Specifically, while the adjustment of compensation is stopped, the adjustment signal acquired in the n-th adjustment is stored in the first storage unit 9 or the second storage unit 15. When rebooting, the display panel 4 automatically acquires the adjustment signal in the storage units and compensates the common voltage.

In the present embodiment, the common voltage compensation system 16 of the display panel 4 automatically adjusts the compensation of each display panel 4 many times in the phase of adjusting the display panel. When a compensation effect is better, the adjustment is stopped, causing each display panel 4 to have a better compensation result. Simultaneously, the storage unit of the compensation circuit 1 of each display panel 4 stores the adjustment signal with a better compensation effect, causing the display panel 4 to automatically acquire the adjustment signal in the storage unit and to compensate the common voltage when the display panel 4 reboots. It is realized that the common voltage compensation circuit 1 of the display panel 4 automatically compensates the common voltage every time the display panel 4 boots.

In conclusion, although the present disclosure has been described with reference to the foregoing preferred embodiments thereof, it is not limited to the foregoing preferred embodiments. It is apparent to those skilled in the art that a variety of modifications and changes may be made without departing from the scope of the present disclosure which is intended to be defined by the appended claims.

What is claimed is:

1. A common voltage compensation circuit for a display panel, comprising:

a compensating unit configured to: receive a common voltage outputted by the display panel; compensate the common voltage according to a compensation coefficient; and output the compensated common voltage to the display panel; and an adjusting unit configured to: connect with a controller in a phase of adjusting the display panel; receive an adjustment signal outputted by the controller; and adjust the compensation coefficient of the compensating unit according to the adjustment signal;

wherein the adjusting unit comprises:

a resistor-array unit electrically connected to the compensating unit and configured to adjust the compensation coefficient of the compensating unit according to a change of resistance values;

a switch unit electrically connected to the resistor-array unit and configured to adjust a resistance value of the resistor-array unit according to a working state of switches; and a signal-processer electrically connected to the switch unit and configured to: connect with the controller in the phase of adjusting the display panel; receive the adjustment signal outputted by the controller; and adjust a working state of switches in the switch unit according to the adjustment signal;

wherein the resistor-array unit comprises a first resistor array and a second resistor array both electrically connected to the switch unit, and the compensation coefficient is a resistance ratio of the second resistor array to the first resistor array; and wherein the adjusting unit is further configured to adjust resistance values of the first resistor array and the second resistor array to adjust the compensation coefficient according to the adjustment signal.

2. The common voltage compensation circuit of claim 1, wherein the adjusting unit comprises a first resistor and an adjustable varistor, and the compensation coefficient is a resistance ratio of the adjustable varistor to the first resistor; and wherein the adjusting unit is further configured to adjust a resistance value of the adjustable varistor to adjust the compensation coefficient according to the adjustment signal.

3. The common voltage compensation circuit of claim 2, wherein the compensating unit comprises an operational amplifier, an inverting input of the operational amplifier is electrically connected to a common-voltage providing terminal of the display panel through the first resistor, a non-inverting input of the operational amplifier is electrically connected to a base common-voltage providing terminal of the display panel, one end of the adjustable varistor is electrically connected to the inverting input of the operational amplifier, the other end of the adjustable varistor is electrically connected to an output of the operational amplifier, and the output of the operational amplifier is configured to output the compensated common voltage.

4. The common voltage compensation circuit of claim 2, wherein the adjustable varistor comprises a sliding varistor.

5. The common voltage compensation circuit of claim 2, wherein the adjustable varistor comprises a digital potentiometer.

6. The common voltage compensation circuit of claim 5, wherein the digital potentiometer comprises:

a first resistor-array unit electrically connected to the compensating unit and configured to adjust the compensation coefficient of the compensating unit according to a change of resistance values;

a first switch unit electrically connected to the first resistor-array unit and configured to adjust a resistance value of the first resistor-array unit according to a working state of switches; and a first signal-processer electrically connected to the first switch unit and configured to: connect with the controller in the phase of adjusting the display panel; receive the adjustment signal outputted by the controller; and adjust a working state of switches in the first switch unit according to the adjustment signal.

7. The common voltage compensation circuit of claim 6, wherein the first resistor-array unit comprises a plurality of parallel resistors arranged from small to great resistance values.

8. The common voltage compensation circuit of claim 6, wherein the compensating unit comprises an operational amplifier, an inverting input of the operational amplifier is electrically connected to a common-voltage providing terminal of the display panel through the first resistor, a non-inverting input of the operational amplifier is electrically connected to a base common-voltage providing terminal of the display panel, one end of the first resistor-array unit is electrically connected to the inverting input of the operational amplifier, the other end of the first resistor-array unit is electrically connected to an output of the operational amplifier, and the output of the operational amplifier is configured to output the compensated common voltage.

9. The common voltage compensation circuit of claim 6, wherein the digital potentiometer further comprises a first storage unit electrically connected to the first signal-processer and configured to store the adjustment signal outputted by the controller.

10. The common voltage compensation circuit of claim 1, wherein the compensating unit comprises an operational amplifier, one end of the first resistor array is electrically connected to a common-voltage providing terminal of the display panel, the other end of the first resistor array is electrically connected to one end of the second resistor array and to an inverting input of the operational amplifier, the other end of the second resistor array is electrically connected to an output of the operational amplifier, a non-inverting input of the operational amplifier is electrically connected to a base common-voltage providing terminal, and the output of the operational amplifier is configured to output the compensated common voltage.

11. The common voltage compensation circuit of claim 1, wherein the first resistor array comprises a plurality of parallel resistors arranged from small to great resistance values.

12. The common voltage compensation circuit of claim 1, wherein the second resistor array comprises a plurality of parallel resistors arranged from small to great resistance values.

13. The common voltage compensation circuit of claim 1, wherein the adjusting unit further comprises a second storage unit electrically connected to the signal-processer and configured to store the adjustment signal outputted by the controller.

* * * * *